US005233950A

United States Patent [19]

Umemoto et al.

[11] Patent Number: 5,233,950

[45] Date of Patent: Aug. 10, 1993

[54] VALVE OPERATING SYSTEM FOR INTERNAL COMBUSTION ENGINE

[75] Inventors: Atsushi Umemoto; Kazuji Ono; Kiwamu Bushimata; Iwao Kadota, all of Saitama, Japan

[73] Assignee: Honda Giken Kogyo Kabushiki Kaisha, Tokyo, Japan

[21] Appl. No.: 932,459

[22] Filed: Aug. 20, 1992

[30] Foreign Application Priority Data

Aug. 21, 1991 [JP] Japan ..... 3-209141
Aug. 27, 1991 [JP] Japan ..... 3-240443

[51] Int. Cl.[5] ..... F01L 9/02
[52] U.S. Cl. ..... 123/90.14; 123/90.65
[58] Field of Search ..... 123/90.14, 90.12, 90.13, 123/90.27, 90.65

[56] References Cited

U.S. PATENT DOCUMENTS 4,592,313 6/1986 Speckhart ..... 123/90.65
5,022,358 6/1991 Richeson ..... 123/90.14
5,058,538 10/1991 Erickson et al. ..... 123/90.65
5,058,541 10/1991 Shibata et al. ..... 123/90.65

FOREIGN PATENT DOCUMENTS 2364328 4/1978 France ..... 123/90.14
2529616 6/1982 France ..... 123/90.14
2537207 6/1984 France ..... 123/90.14
283806 11/1990 Japan ..... 123/90.14
283809 11/1990 Japan ..... 123/90.14
2102065 1/1983 United Kingdom ..... 123/90.14

*Primary Examiner*—E. Rollins Cross
*Assistant Examiner*—Weilun Lo
*Attorney, Agent, or Firm*—Lyon & Lyon

[57] ABSTRACT

A valve operating system in a multicylinder internal combustion engine, including an air pressure chamber biasing each engine valve in a closed direction thereof. The air pressure chambers are formed in a member positioned between the engine valves and the cam shaft and the member is formed with an air supply passage connected to the air pressure chambers for supplying air thereto and a relief passage connected to the air pressure chambers for releasing air therefrom. Air relief valves are provided in the member for individually releasing air from the air pressure chambers to the relief passage. A pressure control valve is connected to the relief passage for controlling pressure in the air pressure chambers for improving the accuracy of the operation of the relief valves and the control of the pressure in each the plurality of air pressure chambers.

18 Claims, 19 Drawing Sheets

VALVE OPERATING SYSTEM FOR INTERNAL COMBUSTION ENGINE

BACKGROUND OF THE INVENTION

1. Field of the Invention

The present invention relates to a valve operating system for an internal combustion engine of the type, having air pressure chambers for biasing the engine valves in the closed direction thereof and, in particular, the type having; an air supply passage connected to the air pressure chambers for supplying air thereto and a relief passage connected to the air pressure chambers for releasing air therefrom.

2. Description of the Prior Art

There is a conventionally known valve operating system in which the pressure in an air pressure chamber is varied in accordance with the operational state of the engine, thereby varying the load of the air spring on the valve, as described in, e.g., Japanese Patent Application Laid-open No. 230910/90.

In such a conventional valve operating system, however, air pressure in the air pressure chamber is controlled at the air-supply side where air is supplied to the air pressure chamber. Therefore, due to a difference in the amount of air flowing into each of a plurality of air pressure chambers which are provided corresponding to respective engine valves of cylinders, as well as due to deviation in the amount of air leaking from each of the air pressure chambers, the actual air pressure in each of the air pressure chambers may be deviated from a target value, or a difference in pressure in the air pressure chambers may become large, which hinders the objective of increasing the maximum number of revolutions of the engine. Further, during a transitional stage where the operational state of the engine is changing, the pressure in the air pressure chamber may not be change swiftly and thus the followability of the valve with the cam may be poor.

Further, when the known conventional valve operating system is applied to a multi-cylinder type internal combustion engine, one pressure chamber defining member is secured to the cylinder head with respective to each cylinder and a piston which is operatively connected to the cam shaft common to all the cylinders and which is secured to an engine valve for each cylinder is slidably received in each pressure chamber defining member to define an air chamber between each pressure chamber defining member and the piston. Therefore, passages which should be connected to each of the air pressure chambers are connected to each of the pressure chamber defining members. Thus, the number of parts is increased, the structure becomes complicated, and sealability becomes poor. Moreover, the cam shaft is rotatbly supported by a cam holder which is mounted to the cylinder head between each of the pressure chamber defining members and thus, the construction becomes more complicated.

SUMMARY OF THE INVENTION

The present invention has been developed in view of the above problems, and it is an object of the invention to provide a valve operating system for an internal combustion engine which can precisely control the pressure in the air pressure chamber and can improve the responsiveness of the system during a transitional stage where the operation state of the engine is changing.

To achieve the above object, according to the present invention, a pressure control valve for controlling the pressure in the air pressure chamber is connected to a relief valve, thereby controlling such pressure in the air pressure chamber by the pressure control valve which is closer to the relief valve. Accordingly, the accuracy of the operation of the relief valve is improved to precisely balance the pressure among the plurality of air pressure chambers and thus, the responsiveness for controlling the pressure in the air pressure chambers during changing the operational state of the engine can be improved.

It is an another object of the invention to provide a valve operating system of this type for an internal combustion engine which can reduce the number of parts and simplify the structure, and a high reliability in the sealability can be obtained. To achieve this object, the engine has a plurality of cylinders and a pressure chamber defining member is secured to the cylinder head of the engine so as to correspond to all or some of the plurality of cylinders; a cam shaft common to all the cylinders is operatively connected with the pistons, each of which is secured to an engine valve for each of the cylinders; the pistons are each slidably received in the pressure chamber defining member, and each of the pressure chamber defining members being provided, commonly for all of the air pressure chambers, with a passage which forms portions of the air relief passage and the air supply passage, respectively, and with a bearing portion for rotatably supporting the cam shaft.

The above and other objects, features and advantages of the invention will become apparent from the following description of the preferred embodiments, taken in conjunction with the accompanying drawings.

BRIEF DESCRIPTION OF THE DRAWINGS

FIGS. 1 to 10 show a first embodiment of the present invention, wherein

FIG. 1 is a schematic plan view of a valve operating system of the invention;

FIG. 2 is a sectional view of the system taken along line 2—2 in FIG. 1;

FIG. 3 is an enlarged longitudinal sectional view of an essential portion of FIG. 2;

FIG. 4 is a partial plan view of component members of a pressure chamber;

FIG. 5 is a partial perspective view of the component members of the pressure chamber;

FIG. 6 is a sectional view of the valve operating system taken along line 6—6 in FIG. 1;

FIG. 7 is a side view of an internal combustion engine taken in the direction of arrow 7 shown in FIG. 1;

FIG. 8 is an enlarged sectional view taken along line 8—8 in FIG. 7;

FIG. 9*a–c* are graphs showing variations in the pressure in the air pressure chamber with respective to the engine revolution number;

FIG. 10*a* and *b* are graphs showing variations in a target air pressure caused by variations in the pressure in an accumulator:

DESCRIPTION OF THE PREFERRED EMBODIMENTS

A first embodiment of the present invention will now be described with reference to FIGS. 1 to 10.

Figure 1:
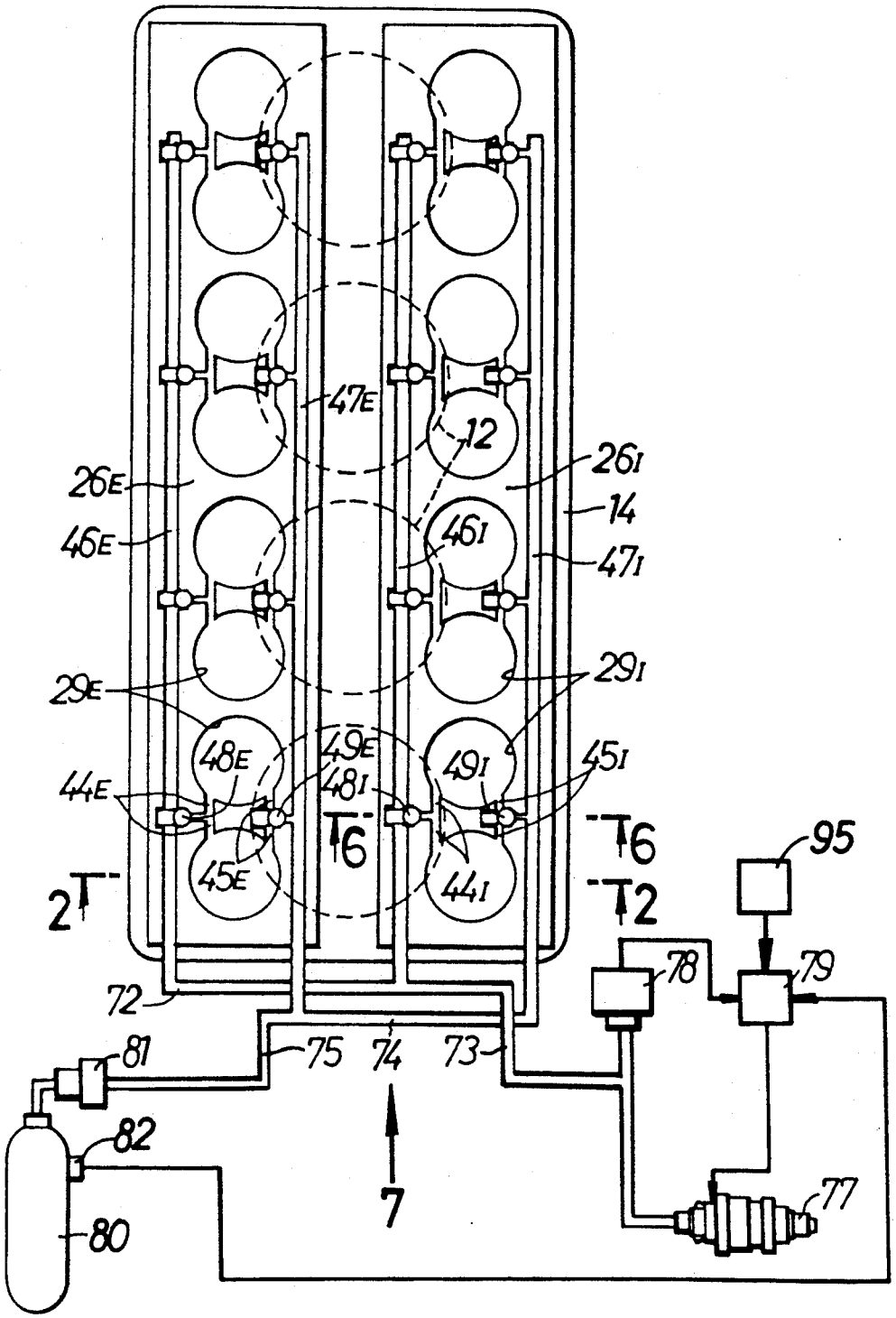
Figure 2:
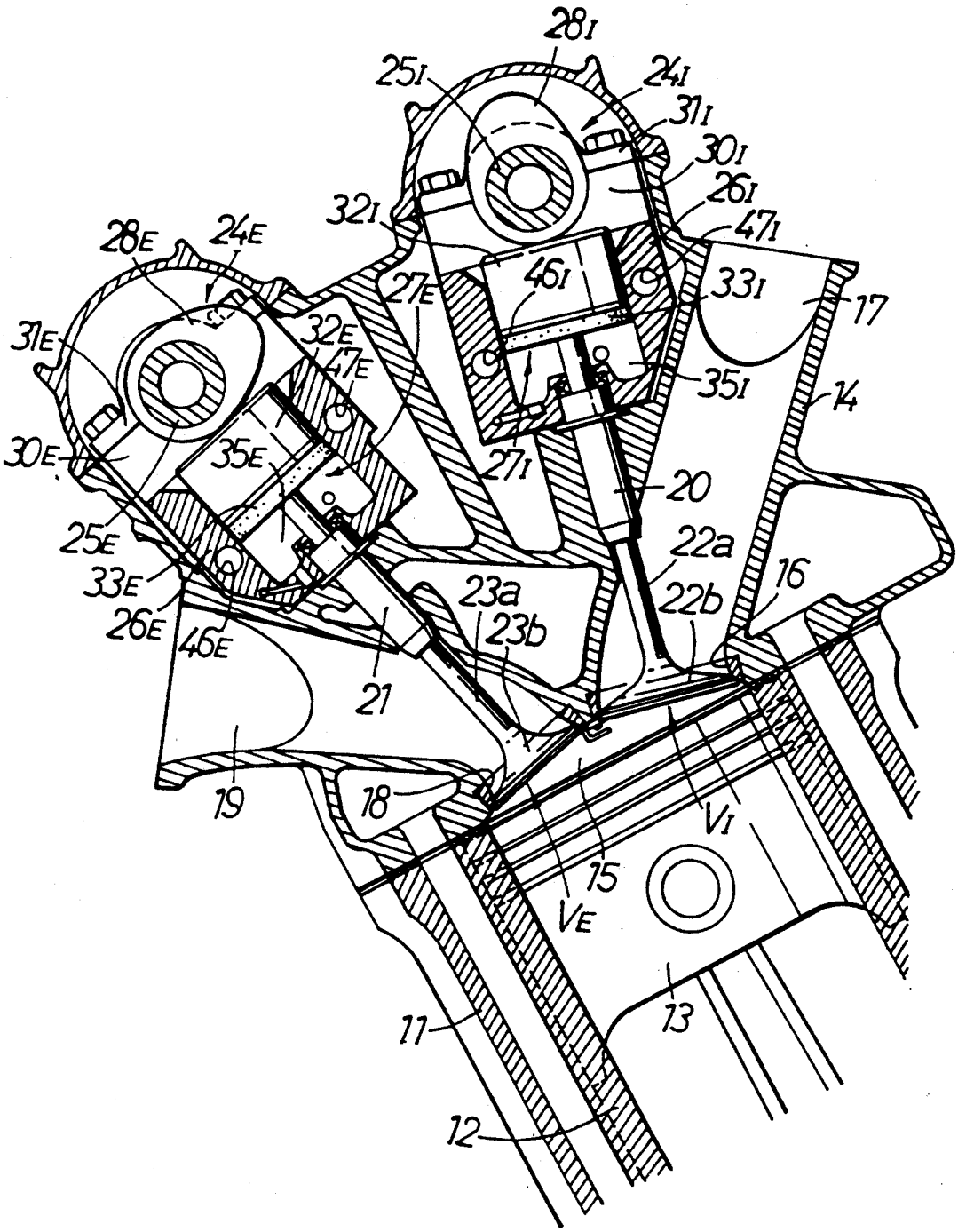

In FIGS. 1 and 2, four cylinders 12 are arranged in series in a cylinder block 11 of a four-cylinder internal combustion engine. In each of the cylinders 12, a combustion chamber 15 is formed between a piston 13 slidably received in each cylinder 12 and a cylinder head 14 coupled to an upper surface of the cylinder block 11. Further, with respect to each of the cylinders 12, provided in the cylinder head 14 are a pair of intake valve openings 16 in the ceiling surface of the combustion chamber 15, an intake port 17 commonly leading to both the intake valve openings 16, a pair of exhaust valve openings 18 in the ceiling surface of the combustion chamber 15, and an exhaust port 19 commonly leading to both the exhaust valve openings 18. A plurality of intake valves $V_I$ are guided for vertical movement by guide cylinders 20 which are mounted in the cylinder head 14 for opening and closing the respective intake valve openings 16. A plurality of exhaust valves $V_E$ are guided for vertical movement by guide cylinders 21 which are mounted in the cylinder head 14 for opening and closing the respective exhaust valve openings 18.

Each of the intake valves $V_I$ is comprised of a valve stem 22*a* which is slidably passed through the guide cylinder 20, and a valve body 22*b* mounted to a tip end of the valve stem 22*a* for opening and closing the intake valve opening 16.

Each of the intake valves $V_I$ is opened and closed by an intake-side valve operating system $24_I$, and each of the exhaust valves $V_E$ is opened and closed by an exhaust-side valve operating system $24_E$. Since both the intake-side and exhaust-side valve operating systems $24_I$ and $24_E$ have basically the same structure, only the structure of the intake-side system $24_I$ will be described in detail below. Each of component elements of the intake-side valve operating system $24_I$ will be indicated by a numeral reference with a subscript letter " " added thereto. As to the exhaust-side valve operating system $24_E$, the corresponding component elements thereof are illustrated in the drawings with the same numerals as those of the system $24_I$ but with a subscript letter " " added thereto and will not be described.

Figure 3:
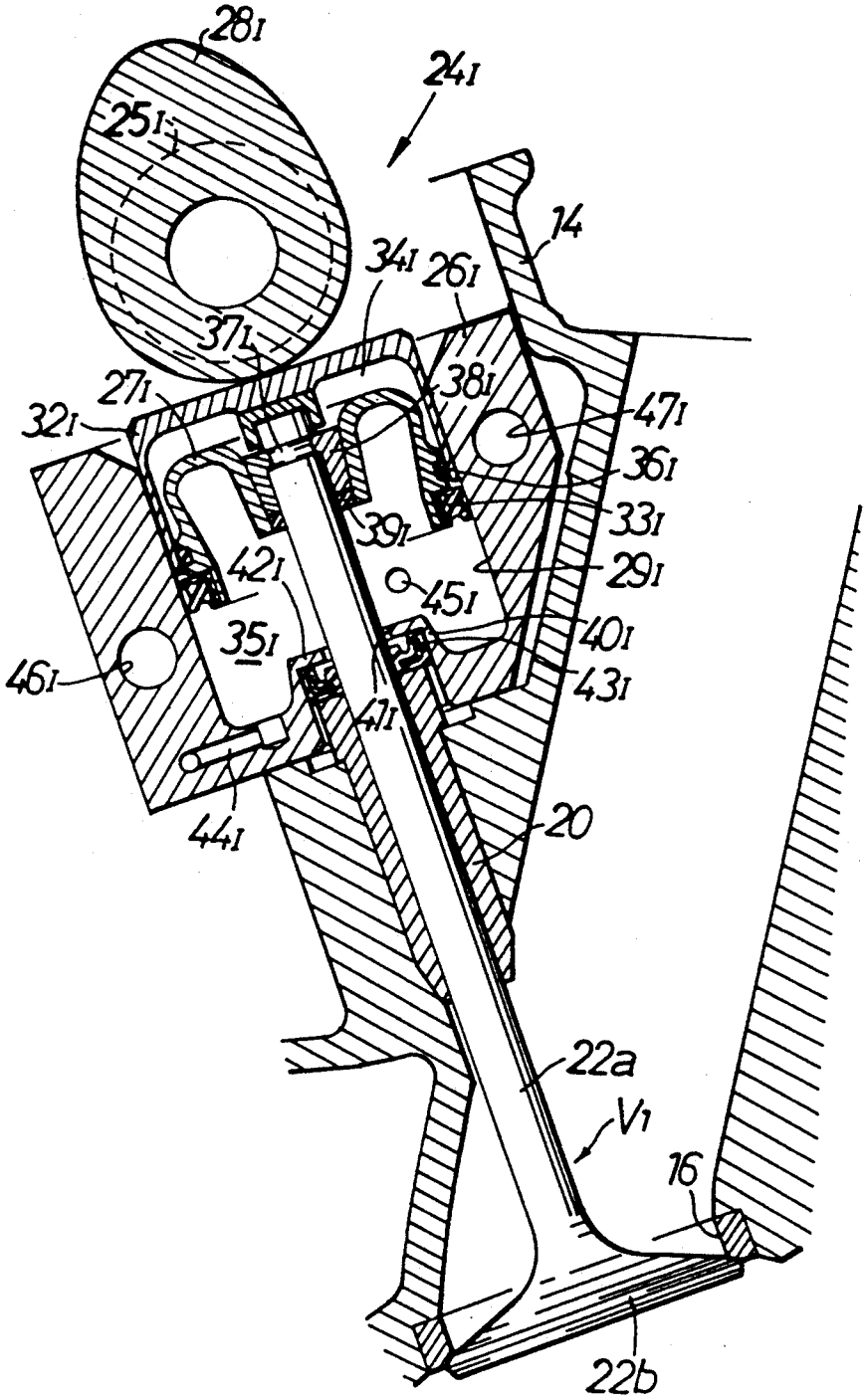

In FIG. 3, the intake-side valve operating system $24_I$ comprises; a cam shaft $25_I$ having an axis perpendicular to that of the valve stem 22*a* of each of the intake valves $V_I$ is commonly disposed for all of the cylinders 12; a pressure chamber defining member $26_I$ which is fixed to the cylinder head 14; and a piston $27_I$ which is operatively connected to the cam shaft $25_I$ and fixed to each intake valves $V_I$. The pistons 27 are slidably received in the pressure chamber defining member $26_I$.

The cam shaft $25_I$ is rotated by a crankshaft (not shown) at a reduction ratio of ½, and is disposed above the intake valves $V_I$. Further, the cam shaft $25_I$ is integrally provided with cams $28_I$ at positions corresponding to each of the intake valves $V_I$.

Figure 4:
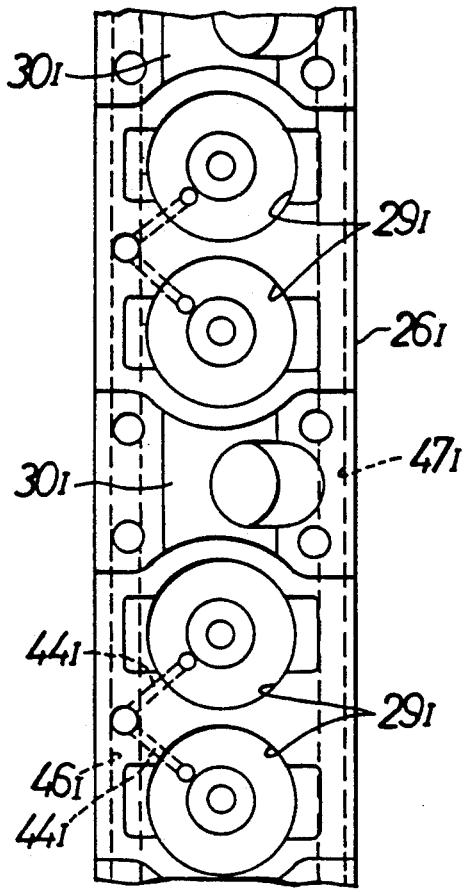
Figure 5:
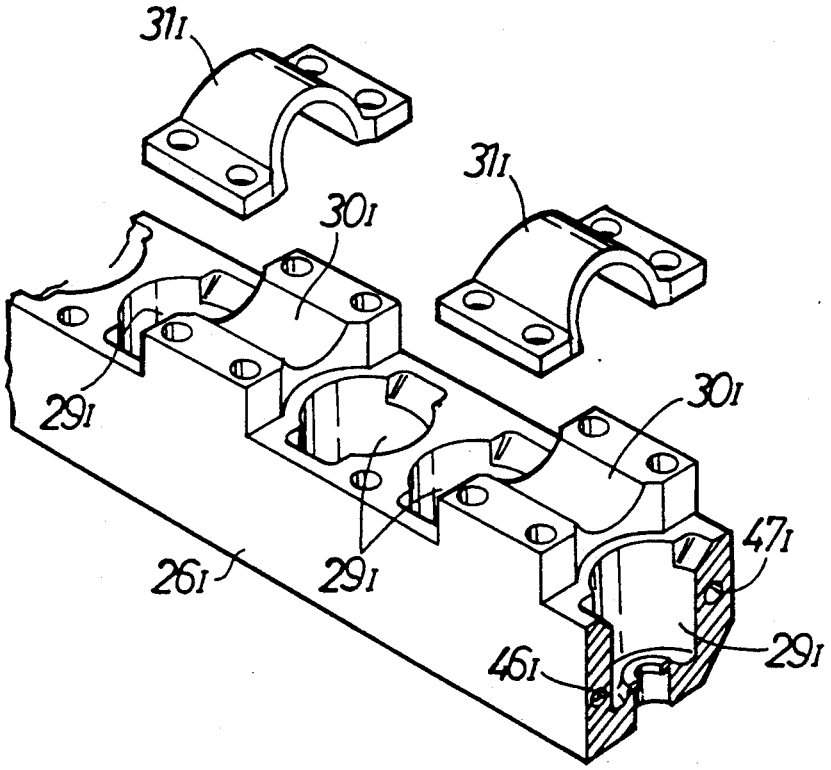

Referring also to FIGS. 4 and 5, the pressure chamber defining member $26_I$ is common for all the cylinders 12, and is formed in a rectangular block-like shape along the series of cylinders 12, and coupled to the cylinder head 14 at a position corresponding to the intake Valves $V_I$. The pressure chamber defining member $26_I$ is provided with a plurality of slide holes $29_I$ which correspond to each of the intake valves $V_I$ (in this embodiment, there are four pairs of slide holes $29_I$, one pair for each cylinder 12). The slide holes $29_I$ are opened upwardly in the pressure chamber defining member $26_I$ and are coaxial with the valve stems 22*a* of the intake valves $V_I$. A rear end, i.e., an upper end, of each of the valve stems 22*a* is oil-tightly and movably passed through a bottom portion of the pressure chamber defining member $26_I$, and is coaxially projected into the slide hole $29_I$.

Semi-circular bearing portions $30_I$ for supporting the lower half of the cam shaft $25_I$ are provided on an upper portion of the pressure chamber defining member $26_I$ at positions between adjacent cylinders 12 as well as at longitudinally opposite ends of the member $26_I$. Holders $31_I$ are coupled to upper portions of the respective bearing portions $30_I$ for rotatably supporting upper half of the cam shaft $25_I$ in cooperation with the respective bearing portions $30_I$.

A bottomed cylindrical lifter $32_I$ is slidably received in each of the slide holes $29_1$ with the closed end of the lifter $32_I$ facing up. Therefore, the outer surface of the closed end of the lifter $32_I$ comes into sliding contact with the cam $28_I$ and the inner surface of the closed end of the lifter $32_I$ abuts against the rear end, i. e., the upper end, of the valve stem 22*a* of the intake valve $V_I$. In other words, the lifter $32_I$ is interposed between the cam $28_I$ and the valve stem 22*a*.

The piston $27_I$ is secured to the upper end portion of the valve stem 22*a*. The piston $27_I$ is slidably received in the slide hole $29_I$ through an annular seal member $33_I$ made of resilient material, and is inserted in the lifter $32_I$ to define an air chamber $34_I$ between the piston $27_I$ itself and the closed end of the lifter $32_I$. An air pressure chamber $35_I$ is defined between the piston $27_I$ and a bottom portion of the slide hole $29_I$. The piston $27_I$ is formed into a double cylindrical shape whose upper end closer to the lifter $32_I$ is occluded. The piston $27_I$ is provided, around an outer surface thereof above the seal member $33_I$, with an O-ring $36_I$ for sliding contact with an inner surface of the lifter $32_I$.

The valve stem 22*a* is provided at an upper end portion thereof with an annular engaging groove $37_I$. The piston $27_I$ is fixed to the upper end portion of the valve stem 22*a* through a split cotter $38_I$ which engages the engaging groove $37_I$. Further, in order to prevent a leakage of pressurized air into the air chamber $34_I$ from between the piston $27_I$ and outer surfaces of the cotter $38_I$ as well as between the piston $27_I$ and the valve stem 22a, a seal member $39_I$ for the valve stem 22a is provided inside the piston $27_I$ below the cotter $38_I$.

A bottom portion of the slide hole $29_I$, i.e., a lower end portion of the pressure chamber defining member $26_I$ is coaxially provided with a cylindrical portion $40_I$ projecting into the air pressure chamber $35_I$. The cylindrical portion $40_I$ is integrally provided at an upper end thereof with a radially inwardly extended flange $42_I$. A hole $41_I$ is defined by an inner edge of the flange through which the valve stem 22a is movably passed. An upper portion of the guide cylinder 20 is inserted into the cylindrical portion $40_I$. An annular valve stem seal member $43_I$ is received in the cylindrical portion $40_I$ such that the valve stem seal member $43_I$ is clamped between the guide cylinder 20 and the flange $42_I$.

With respect to each of the air pressure chambers $35_I$, an individual relief passage $44_I$ leading from a lower portion of each air pressure chamber $35_I$, and an individual supply passage $45_I$ leading from an intermediate portion of each air pressure chamber $35_I$ are provided in the pressure chamber defining member $26_I$. The pressure chamber defining member $26_I$ is provided at one side thereof along the series of slide holes $29_I$ with an intake-side common relief passage $46_I$ which is common for all the air pressure chambers $35_I$. One end of the relief passage $46_I$ is closed. The pressure chamber defining member $26_I$ is also provided at the other side along the series of slide holes $29_I$ of the pressure chamber defining member $26_I$ with an intakeside common supply passage $47_I$ which is common for all the air pressure chambers $35_I$. One end of the supply passage $47_I$ is closed.

Figure 6:
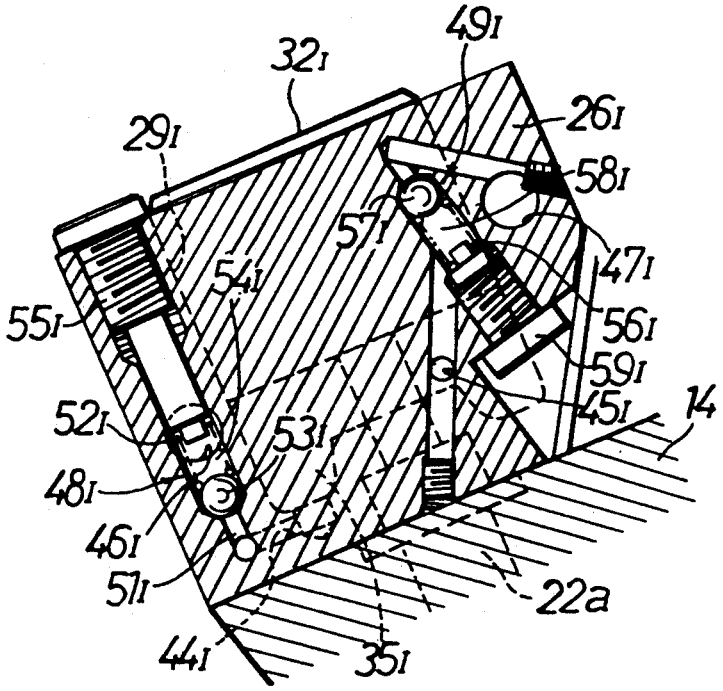

Referring also to FIG. 6, with respect to each of the cylinders 12, a relief valve $48_I$ is interposed between the intake-side common relief passage $46_I$ and the two individual relief passages $44_I$ leading to the two slide holes $29_I$, i.e., the two air pressure chambers $35_I$. Also, with respect to each of the cylinders 12, a check valve $49_I$ is interposed between the intake-side common supply passage $47_I$ and two individual supply passages $45_I$ leading to the two slide holes $29_I$, i.e., two air pressure chambers $35_I$.

Each of the relief valves $48_I$ is disposed in the pressure chamber defining member $26_I$ at a position corresponding to the intake-side common relief passage $46_I$, and between the two slide holes $29_I$, i.e., the two air pressure chambers $35_I$, which are paired for each of the cylinders 12. The relief valve $48_I$ comprises a valve bore $51_I$ commonly leading to the two individual relief passage $44_I$, a spherical valve body $53_I$ biased by a spring $52_I$ in a closed direction of the valve bore $51_I$, and a valve chest $54_I$ for containing therein the valve body $53_I$ and leading to the intake-side common relief passage $46_I$. The spring $52_I$ is compressed between the valve body $53_I$ and a screw member $55_I$ which is threadedly engaged in the pressure chamber defining member $26_I$.

The relief valve $48_I$ is adapted to open to release air including oil from the air pressure chamber $35_I$ when oil in the air pressure chamber $35_I$ exceeds a predetermined amount and the pressure in the air pressure chamber $35_I$ becomes higher than that in the intake-side common relief passage $46_I$ by a predetermined value (e.g., 1kgf/cm$^2$) or more.

Each of the check valves $49_I$ is disposed in the pressure chamber defining member $26_I$ at a position corresponding to the intake-side common supply passage $47_I$ and between the two slide holes $29_I$, i.e., the two air pressure chambers $35_I$ which are paired for each of the cylinders 12. The check valve $49_I$ comprises a valve bore $55_I$ leading to the intake-side common supply passage $47_I$, a spherical valve body $57_I$ biased by a spring $56_I$ in a closed direction of the valve body $57_I$, and a valve chest $58_I$ for containing therein the valve body $57_I$ and commonly leading to the two individual supply passage $45_I$. The spring $56_I$ is compressed between the valve body $57_I$ and a screw member $59_I$ which is threadedly engaged in the pressure chamber defining member $26_I$.

The check valve $49_I$ is adapted to open to supplement pressurized air to the air pressure chamber $35_I$ when air pressure in the air pressure chamber $35_I$ becomes lower than that in the intake-side common supply passage $47_I$ by a given value (e.g., 1kgf cm$^2$) or more.

Figure 7:
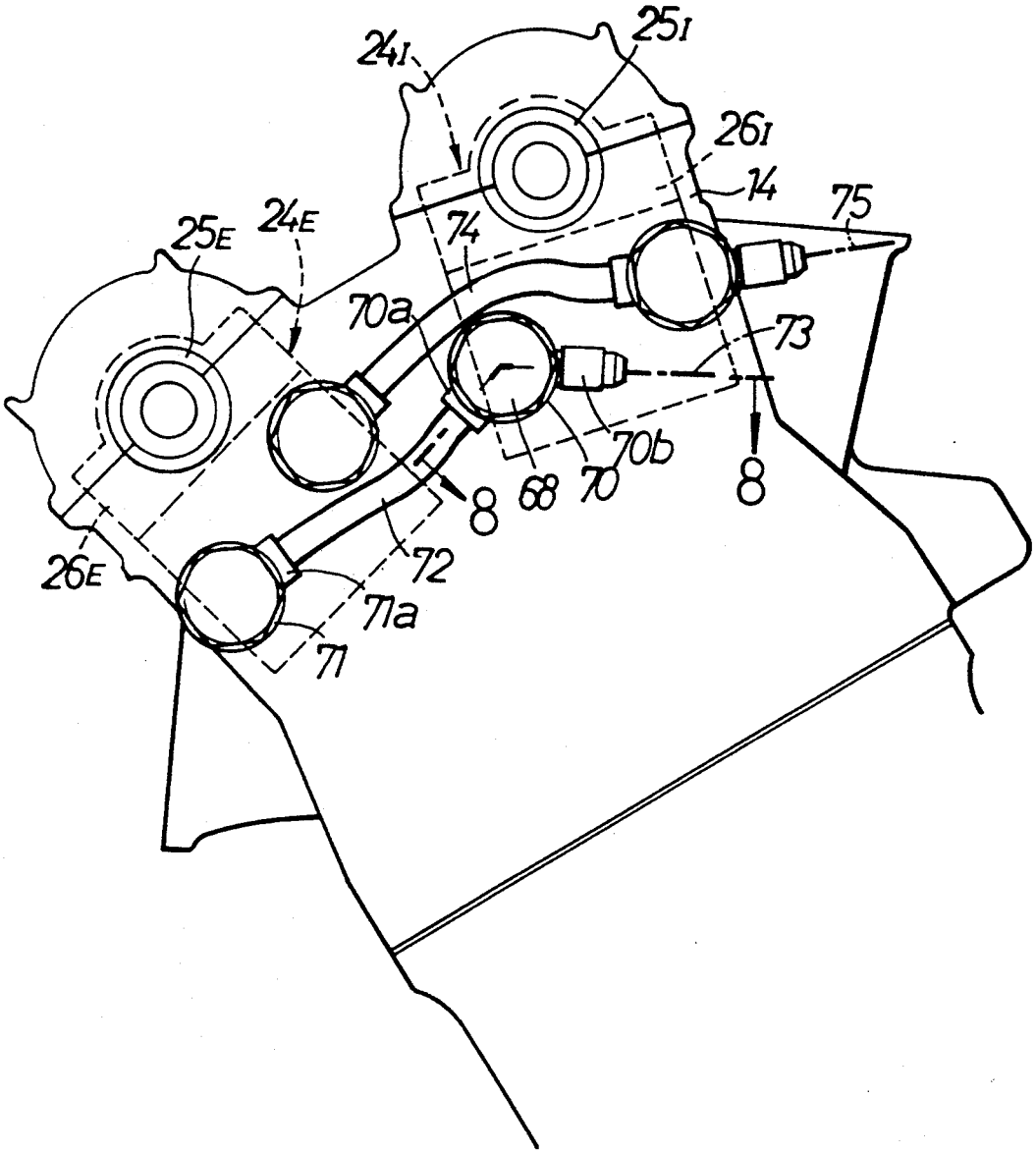
Figure 8:
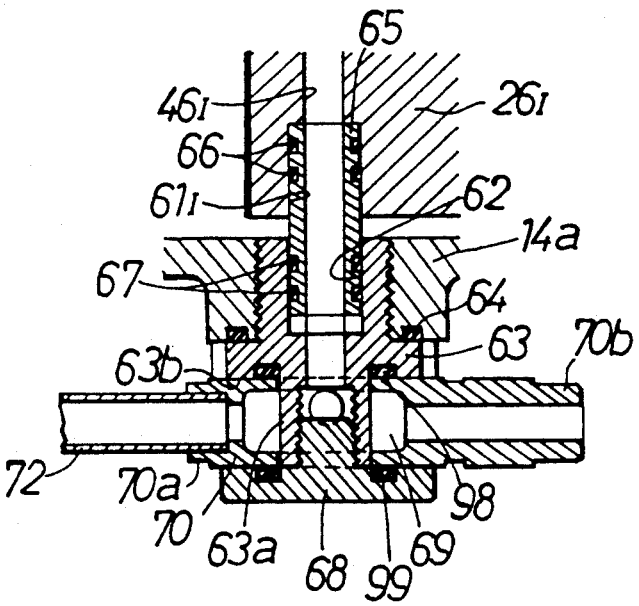

In FIGS. 7 and 8, the other end of the intake-side common relief passage $46_I$, i.e., the end which is not closed, is opened toward an end wall 14a of the cylinder head 14 at one end in the direction of the in-line series of cylinders 12, and is provided with a large-diameter portion $61_I$. A mounting member 63 having a fitting hole 62 which has the same diameter as that of the large-diameter portion $61_I$ and is coaxial therewith is threaded into the end wall 14a. An annular seal member 64 is interposed between the mounting member 63 and the end wall 14a for surrounding the threaded portion therebetween.

A cylindrical joint 65 is received at opposite ends thereof into the large-diameter portion $61_I$ and the fitting hole 62, respectively. The joint 65 is provided at one end outer surface thereof with a pair of annular seal members 66 for sealing contact with an inner surface of the large-diameter portion $61_I$, and is provided at the other end outer surface of the joint 65 with a pair of annular seal members 67 for sealing contact with an inner surface of the fitting hole 62.

A cylindrical projection 63a which is coaxial with the fitting hole 62 is projected outwardly from a step 63b of the mounting member 63, and a bolt 68 is threaded into a tip end of the projection 63a. A ring-like connect member 70 defines between this member 70 itself and the projection 63a an annular chamber 69 leading to the joint 65, and is clamped between the step 63b and the bolt 68. An annular seal member 98 is interposed between the step 63b and the connect member 70, and an another annular seal member 99 is interposed between the bolt 68 and the connect member 70. Further, the connect member 70 is integrally provided with connect tubes 70a and 70b leading to the annular chamber 69.

The exhaust-side common relief passage $46_E$ in the exhaust-side valve operating system $24_E$ has the same structure as the intake-side common relief passage $46_I$ in the intake-side valve operating system $24_I$, and is communicated to a connect member 71 which is mounted to the end wall 14a of the cylinder head 14. A connect tube 71a of the connect member 71 and the connect tube 70a of the connect member 70 are connected to each other through a connect passage 72. Further, a single common relief passage 73 which is common for both the intake-side and exhaust-side valve operating systems $24_I$ and $24_E$ is connected to the connect tube 70b of the connect member 70.

End portions of both the intake-side common supply passage $47_I$ of the intake-side valve operating system $24_I$ and the exhaust-side common supply passage $47_E$ of the exhaust-side valve operating system $24_E$ have the same structure as those of the intake-side and exhaust-side common relief passages $46_I$ and $46_E$, and are connected to each other through the connect passage 74, and connected to a single common supply passage 75 which is common for both the intake-side and exhaust-side valve operating systems $24_I$ and $24_E$.

Referring again to FIG. 1, the common relief passage 73 is disposed so that an end thereof faces a valve operating chamber between the cylinder block 11 and the cylinder head 14. A pressure control valve 77 which is a very accurate solenoid valve is connected to the end of the common relief passage 73. Further, the common relief passage 73 is provided at an intermediate portion thereof with relief pressure detecting means 78 for detecting a pressure in the common relief passage 73, i.e., a relief pressure.

The common supply passage 75 is connected to an accumulator 80 through a regulator 81, and constantly pressurized air is supplied to the common supply passage 75 and thus, to both the intake-side and exhaust-side common supply passages $47_I$ and $47_E$. Further, the accumulator 80 is provided with accumulator internal pressure detecting means 82 for detecting the internal pressure of the accumulator 80.

The opening and closing operation of the pressure control valve 77 is controlled by a control unit 79. The value detected by the relief pressure detecting means 78, the value detected by the accumulator internal pressure detecting means 82 and a value detected by revolution number detecting means 95 for detecting the engine revolution number are inputted to this control unit 79.

The control unit 79 is adapted to control the opening and closing operation of the pressure control valve 77 such that the pressure in the common relief passage 73, i.e., a value detected by the relief pressure detecting means 78 becomes equal to a set value. This set value is a value which is obtained by subtracting an opening valve set pressure of both the relief valves $48_I$ and $48_E$ from the air pressure target value of the air pressure chambers $35_I$ and $35_E$. The air pressure target value is set in accordance with the engine revolution number representing the engine operational state. Thus, the air pressure in the air pressure chambers $35_I$ and $35_E$ is controlled into a target value in accordance with the operational state of the engine.

Figure 9:
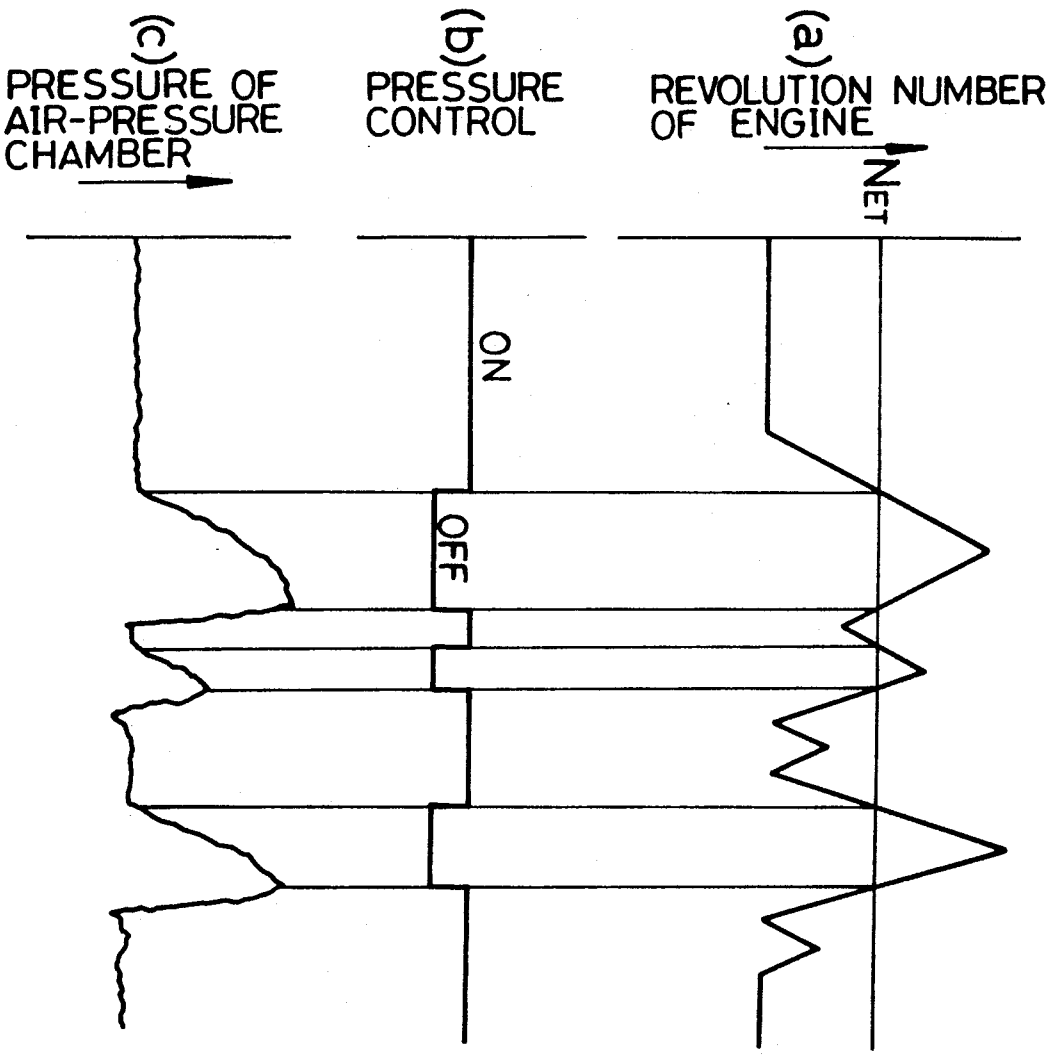

Further, when the engine revolution number becomes equal to or larger than a preset revolution number $N_{ET}$ as shown by graph (a) in FIG. 9, the control unit 79 is turned off, i.e., assumes a state in which the pressure control valve 77 is kept closed and the pressure is not controlled, as shown by graph (b) in FIG. 9. By this arrangement, pressure in each of the air pressure chambers $35_I$ and $35_E$ is swiftly increased as shown by graph (c) in FIG. 9 when the engine revolution number is equal to or larger than the set revolutional number $N_{ET}$.

Figure 10:
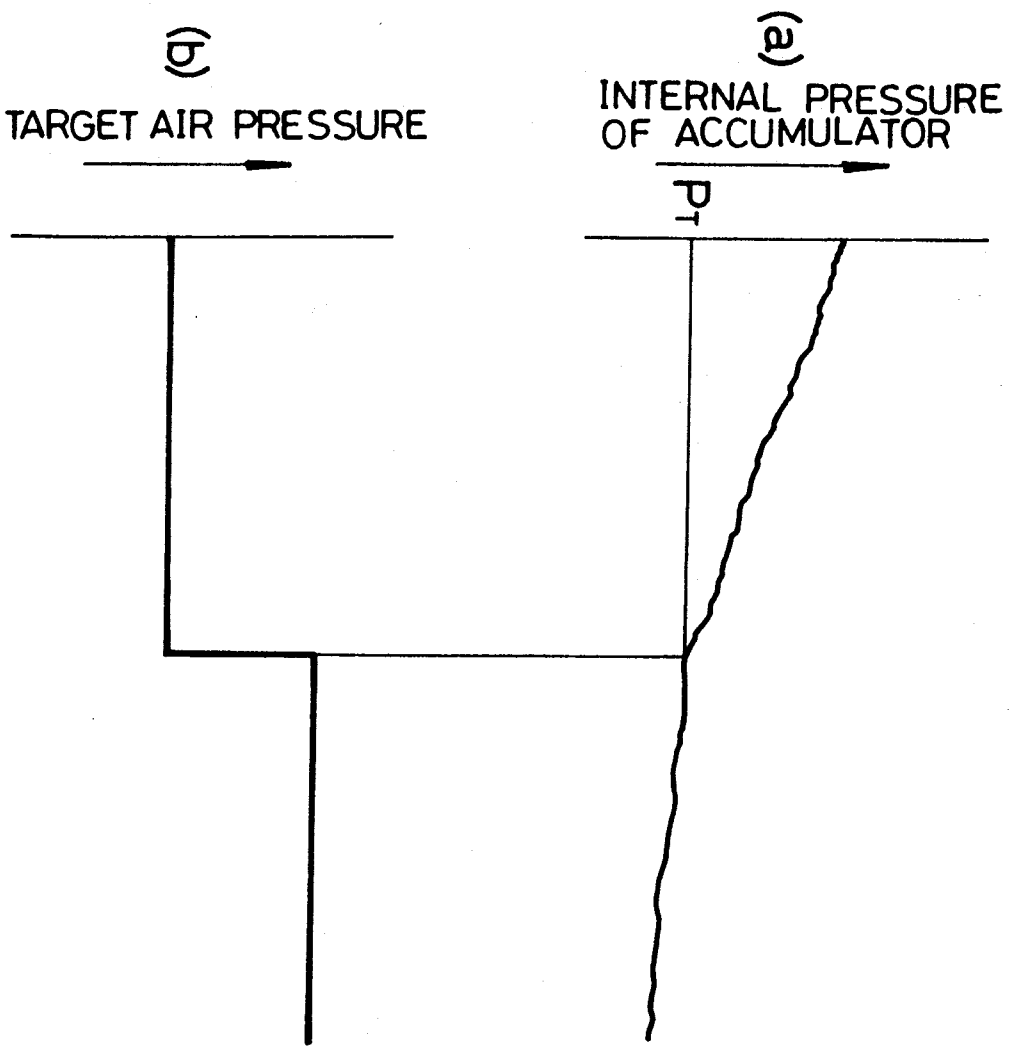

The control unit 79 is adapted such that, when the internal pressure of the accumulator 80 becomes smaller than the set pressure $P_T$, the target air pressure in the air pressure chambers $35_I$ and $35_E$ is changed to a value larger than the target value which was obtained when the internal pressure in the accumulator 80 was equal to or larger than the set pressure $P_T$, as shown by graph (a) in FIG. 10.

The operation of the first embodiment will now be described. In the intake-side and exhaust-side valve operating systems $24_I$ and $24_E$, when the cam shafts $25_I$ and $25_E$ are driven for rotation by the crankshaft, the lifters $32_I$ and $32_E$ are pressed downwardly as they come into sliding contact with lobe portions of the cams $28_I$ and $28_E$, thereby to depress the valve stems 22a and 23a of the intake and exhaust valves $V_I$ and $V_E$, respectively, to separately open both the intake and exhaust valves $V_I$ and $V_E$.

At this time, the pistons $27_I$ and $27_E$ which are secured to the upper end portions of the valve stems 22a and 23a are also pressed downwardly while reducing the volumes of the air pressure chambers $35_I$ and $35_E$, thereby generating air pressure in the air pressure chambers $35_I$ and $35_E$. This causes the intake valve $V_I$ and the exhaust valve $V_E$ to be biased upwardly, i.e., in their closed directions by the air pressure, and the cams $28_I$ and $28_E$ are driven to open the intake valve $V_I$ and the exhaust valve $V_E$ against the biasing forces toward their closed directions by the air pressure.

By such structure in which the intake valve $V_I$ and the exhaust valve $V_E$ are biased in their closed directions by the air pressure as described above, it is possible to rotate the engine at higher speed as compared with an engine of a structure in which such intake and exhaust valves are closed by valve springs, because it is unnecessary to take into account a limit of resonance by natural vibration or oscillation.

In the valve operation system of the present invention, air pressure in the air pressure chambers $35_I$ and $35_E$ are controlled at the air-relief side. Therefore, as compared with the conventional system in which such air pressure is controlled at the air-supply side, it is possible to maintain a difference between the internal pressure of the air pressure chambers $35_I$, $35_E$ and the pressure at the air-relief side to a lower degree, thereby improving the operating accuracy of each of the relief valves $48_I$ and $48_E$. Thus, the pressures in the plurality of air pressure chambers $35_I$ and $35_E$ can be balanced precisely, which makes it possible to improve the responsiveness of the valve operating system when the target value of the air pressure of each of the air pressure chambers $35_I$ and $35_E$ are varied in accordance with the operational condition of the engine.

Furthermore, since the pressure control valve 77 is connected to the single common relief passage 73 which is common for the plurality of the air pressure chambers $35_I$ and $35_E$, it is possible to precisely control pressures in the plurality of air pressure chambers $35_I$ and $35_E$ by the single pressure control valve 77. Thus, the structure of the system can be simplified and the amount of consumption of the pressured air can be reduced as compared with the conventional system in which air released from each of the air pressure chambers $35_I$ and $35_E$ is individually released to outside.

As is shown in FIG. 9, the control of the pressure control valve 77 by the control unit 79 is stopped when the revolution number of the engine becomes equal to or larger then the set revolution number $N_{ET}$. Therefore, in such a case, the pressure in the air pressure chambers $35_I$ and $35_E$ can swiftly be increased and adapted to such variation in the engine revolution number and thus, an appropriate spring load in accordance with the engine revolution number can be obtained.

Further, when the internal pressure of the accumulator 80 is decreased lower than the set pressure $P_T$, the target air pressures of the air pressure chambers $35_I$ and $35_E$ are changed to higher values as shown in FIG. 10. Therefore, when the internal pressure of the accumulator 80 is decreased, the amount of relief air is decreased, thereby preventing an abrupt drop of the internal pressure of the accumulator 80 and thus, the necessary spring load can be maintained.

In the valve operating systems $24_I$ and $24_E$ as described above, the pressure chamber defining members $26_I$ and $26_E$ are provided for all the cylinders 12, and the intake-side and exhaust-side common relief passages $46_I$ and $46_E$ as well as the intake-side and exhaust-side common supply passages $47_I$ and $47_E$ which are common for each of the air pressure chambers $35_I$ and $35_E$ are provided in the pressure chamber defining members $26_I$ and $26_E$, respectively. Therefore, it is possible to make the valve operating systems $24_I$ and $24_E$ compact and to reduce the number of parts thereof. Further, it is possible to reduce the number of connected portions in which sealability must be taken into account, such as portions connected to the intake-side and exhaust-side common relief passages $46_I$ and $46_E$ as well as to the intake-side and exhaust-side common supply passages $47_I$ and $47_E$, thereby enhancing the reliability against leakage of the air pressure.

Further, end portions of the intake-side and exhaust-side common relief passages $46_I$ and $46_E$ as well as end portions of the intake-side and exhaust-side common supply passages $47_I$ and $47_E$ are provided in the pressure chamber defining members $26_I$ and $26_E$, respectively, and are connected to the common relief passage 73 and the common supply passage 75, respectively, through the cylindrical joint 65 or the like which are fitted in the end wall 14a of the cylinder head 14 via the seal members 66 and 67. Therefore, any installation error which may be generated when mounting the cylinder head 14 can be accommodated, thereby to allow the relief and supply of the pressured air.

Furthermore, by providing the bearing portions $30_I$, $30_E$ for supporting the cam shafts $25_I$, $25_E$ on the pressure chamber defining members $26_I$ and $26_E$, respectively, it is possible to maintain a high rigidity against the thrust force caused by the rotation of the cam shaft $25_I$, $25_E$, and to increase the allowable revolution number of the engine and the lift amount of the valves.

The individual relief passages $44_I$, $44_E$ which are connected to the intake-side and exhaust-side common relief passages $46_I$, $46_E$ through the relief valves $48_I$, $48_E$, respectively, are opened into the lower portions of the air pressure chambers $35_I$ and $35_E$, respectively. Thus, when oil in the air pressure chamber $35_I$ and $35_E$ is increased by a given amount so that the internal pressure of these chambers becomes equal to or larger than the predetermined maximum pressure, priority is given to such increased oil to be released first to avoid wasteful release of air and thus, wasteful consumption of the pressured air from the accumulator 80 can be avoided.

Figure 11:
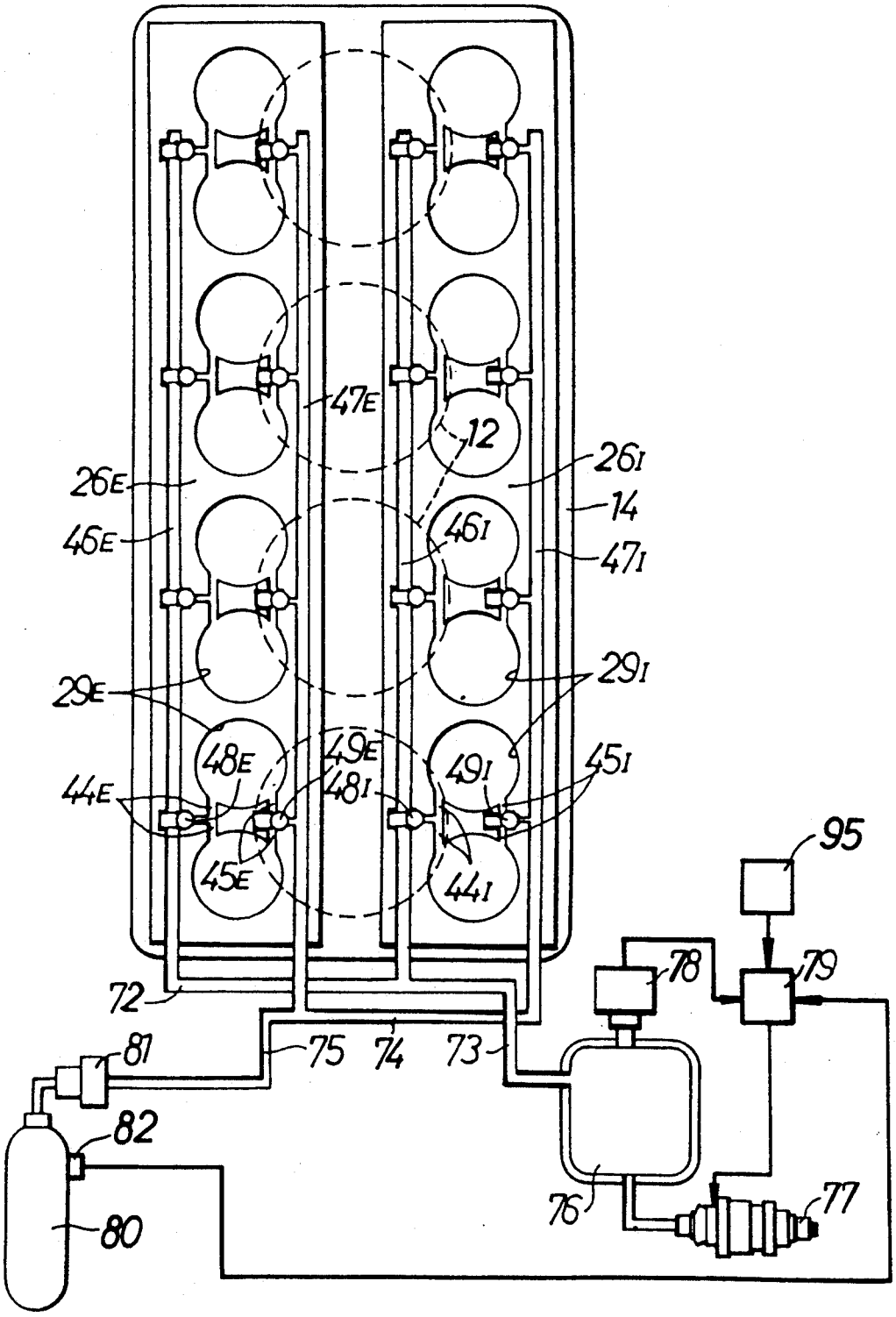
FIG. 11 is similar to FIG. 1 but illustrates a schematic plan view of a valve operating system according to a second embodiment of this invention.

FIG. 11 shows a second embodiment of the present invention, and the similar reference numerals are given to components corresponding to components of the previous first embodiment.

A volume chamber 76 having relief pressure detecting means 78 is mounted in an intermediate portion of the common relief passage 73. A pressure control valve 77 is connected to the common relief passage 73 at a portion downstream of the volume chamber 76.

With such a structure, since the internal pressure of the volume chamber 76 which is mounted in the intermediate portion of the common relief passage 73 is controlled by the pressure control valve 77, any pulse of the relief pressure can be eliminated. Thus, variations can be avoided in the air pressure in the air pressure chamber $35_I$ and $35_E$ in any of the cylinders that may have an adverse influence on air pressure chamber $35_I$ and $35_E$ in other cylinders. Besides, the pressure in each of the air pressure chambers $35_I$, and $35_E$ can be controlled more precisely.

Figure 12:
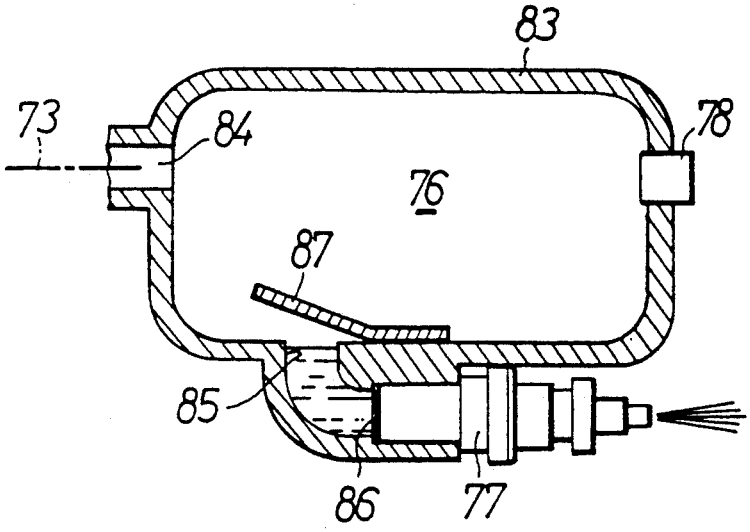
FIG. 12 is a sectional view of a volume chamber according to a third embodiment.

FIG. 12 shows a third embodiment of the present invention. In this embodiment, a closed casing 83 defines therein the volume chamber 76 described with respect to the second embodiment. The casing 83 is provided at one side thereof with a connecting hole 84 leading to the common relief passage 73, and at the other side thereof with the relief pressure detecting means 78. The pressure control valve 77 is connected, through a filter 86, to a relief hole 85 which is opened into a bottom portion of the casing 83. A partition plate 87 which is upwardly obliqued toward the connecting hole 84 is secured to the bottom portion of the casing 83 along its entire width so as to cover the relief hole 85.

With such a structure, oil included in the air which is introduced into the volume chamber 76 from the common relief passage 73 through the connecting hole 84 can be saved in the volume chamber 76 between the connecting hole 84 and the partition plate 87. Therefore, it is possible to release oil first from the relief hole 85 when the pressure control valve 77 is opened and thus, wasteful release of air can be avoided to the utmost. Also, releasing only oil is effective for preventing a degradation of the pressure control valve 77.

Figure 13:
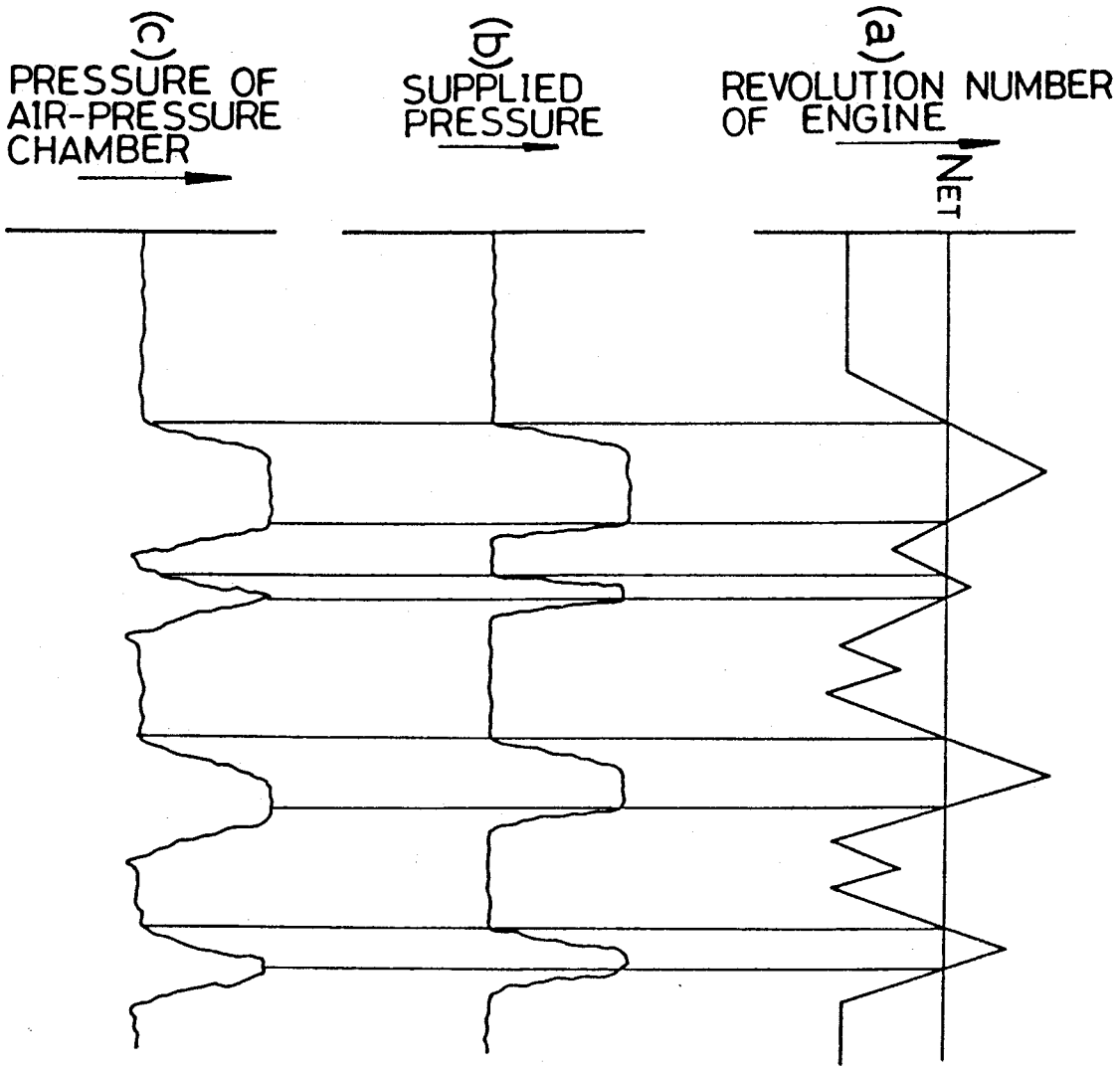
FIG. 13*a–c* are graphs showing variations in the pressure in the air pressure chamber with respective to the engine revolution number according to a fourth embodiment.

FIG. 13 shows a fourth embodiment of the present invention. In this embodiment, the pressure Of the supplied air is controlled in two stages (or multi-stages) as shown by graph (a) in accordance with the engine revolution number exceeding a set engine revolution number $N_{ET}$. With such arrangement, the pressure In the air pressure chambers $35_I$ and $35_E$ is varied as shown by graph (c), and when the engine revolution number is varied substantially, the pressure in the air pressure chambers $35_I$ and $35_E$ can be controlled with better responsiveness in two stages (or multi-stages).

Figure 14:
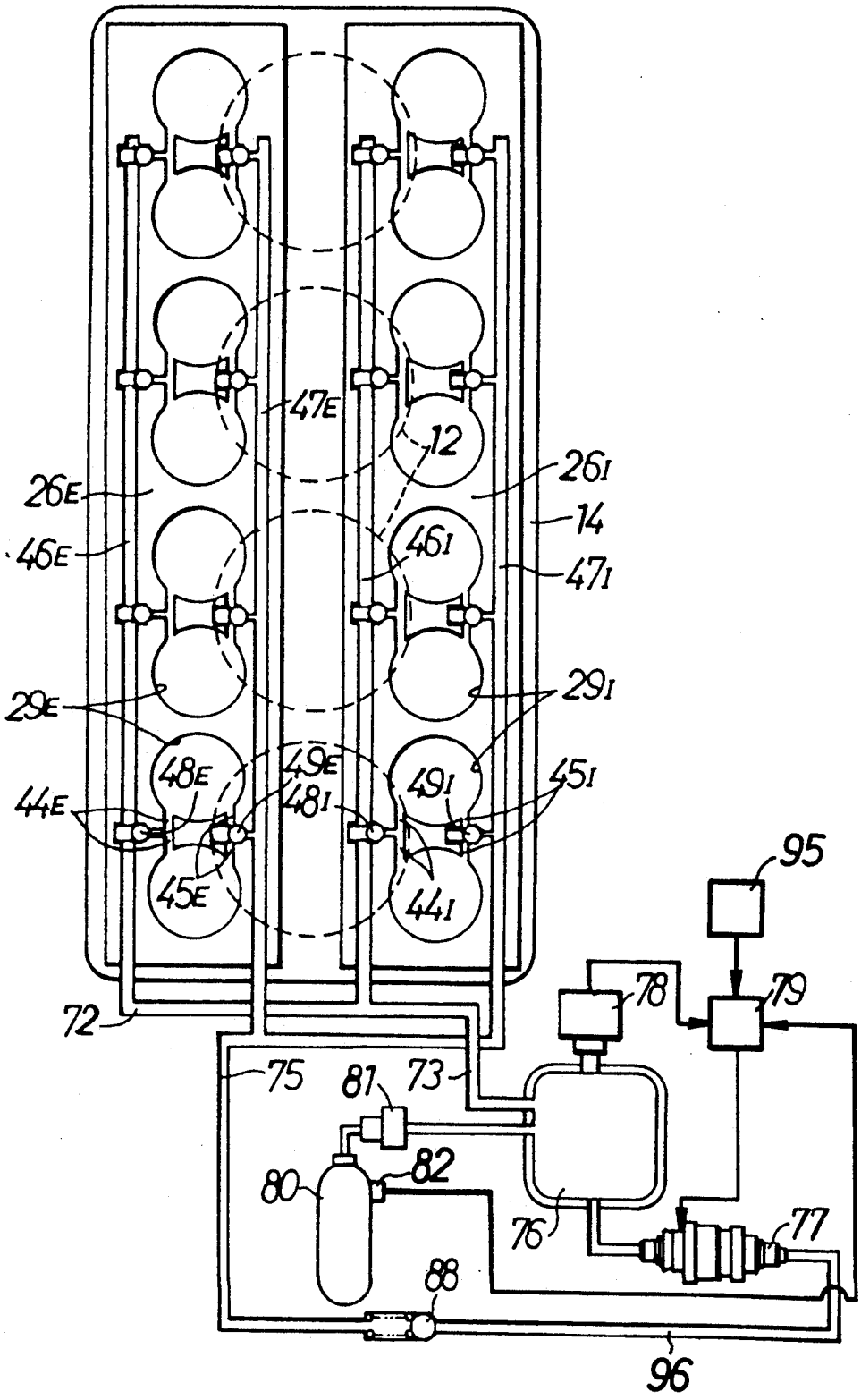
FIG. 14 is similar to FIG. 1 but illustrates a schematic plan view of a valve operating system according to a fifth embodiment of this invention.

FIG. 14 shows a fifth embodiment of the invention, in which the pressure control valve 77 leading to the volume chamber 76 is connected to the common supply passage 75 through a return passage 96 which is provided at an intermediate portion thereof with a check valve 88. The accumulator 80 is connected to the volume chamber 76 through a regulator 81.

By this fifth embodiment, since the highly pressurized air which is controlled by the pressure control valve 77 and released from the volume chamber 76 is returned to the common supply passage 75, air is consumed only by the amount equal to that air which leaked from the air pressure chambers $35_I$ and $35_E$ and thus, the amount of air supplied from the accumulator 80 can largely be reduced.

Figure 15:
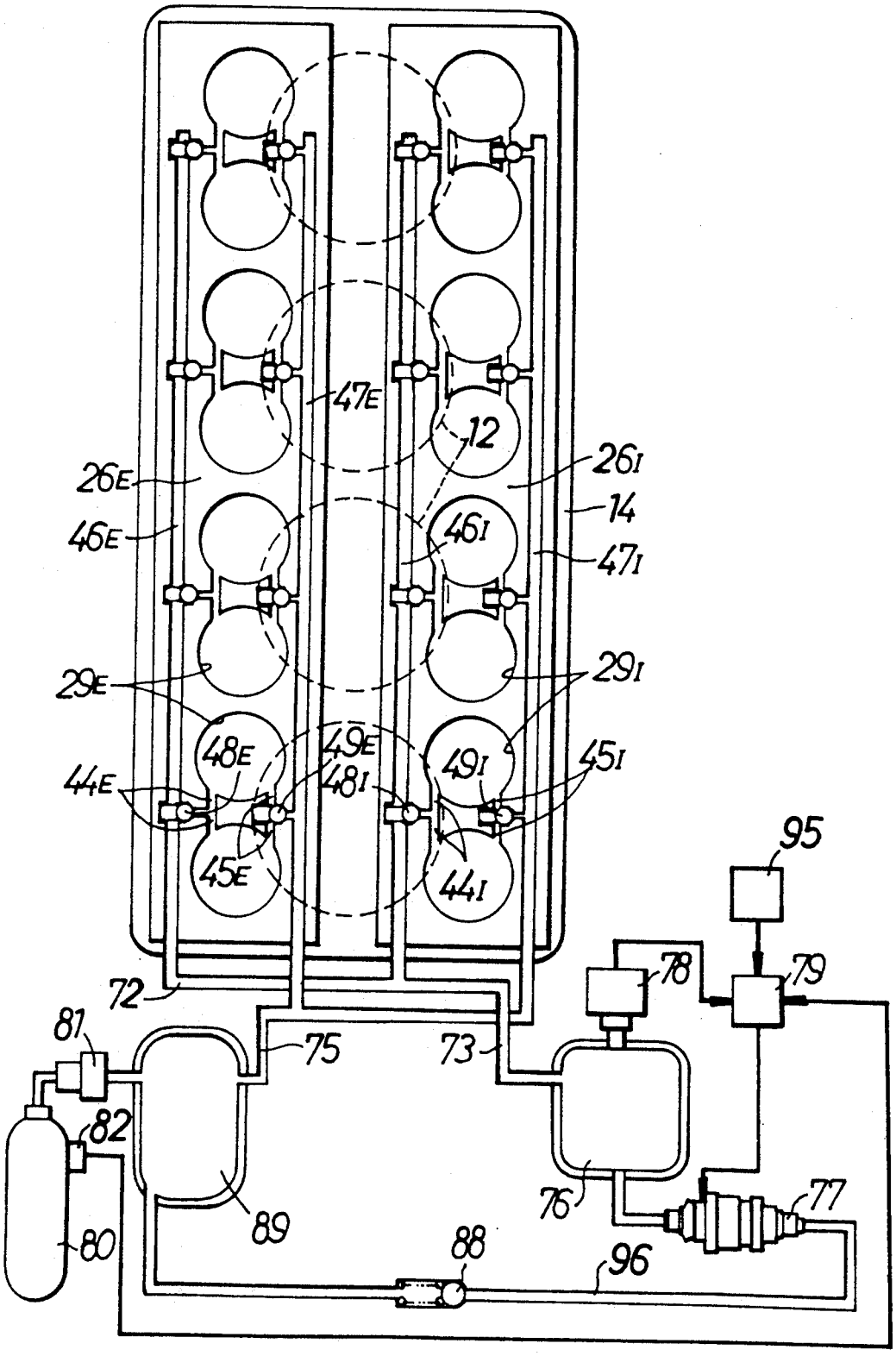
FIG. 15 is similar to FIG. 1 but illustrates a schematic plan view of a valve operating system according to a sixth embodiment of this invention.

FIG. 15 shows a sixth embodiment of the invention, in which the pressure control valve 77 leading from the volume chamber 76 is connected to a volume chamber 89 through the return passage 96 which is provided at an intermediate portion thereof with the check valve 88. The volume chamber 89 is connected to the common supply passage 75, and also to the accumulator 80 through the regulator 81.

By this sixth embodiment, the consumption of air can be reduced by circulating the relief air to the supply side as in the previous fourth embodiment, and it is possible to restrain, by the volume chamber 89, variations in the air pressure generated in the common supply passage 75 at the time of control by the pressure control valve 77.

Figure 16:
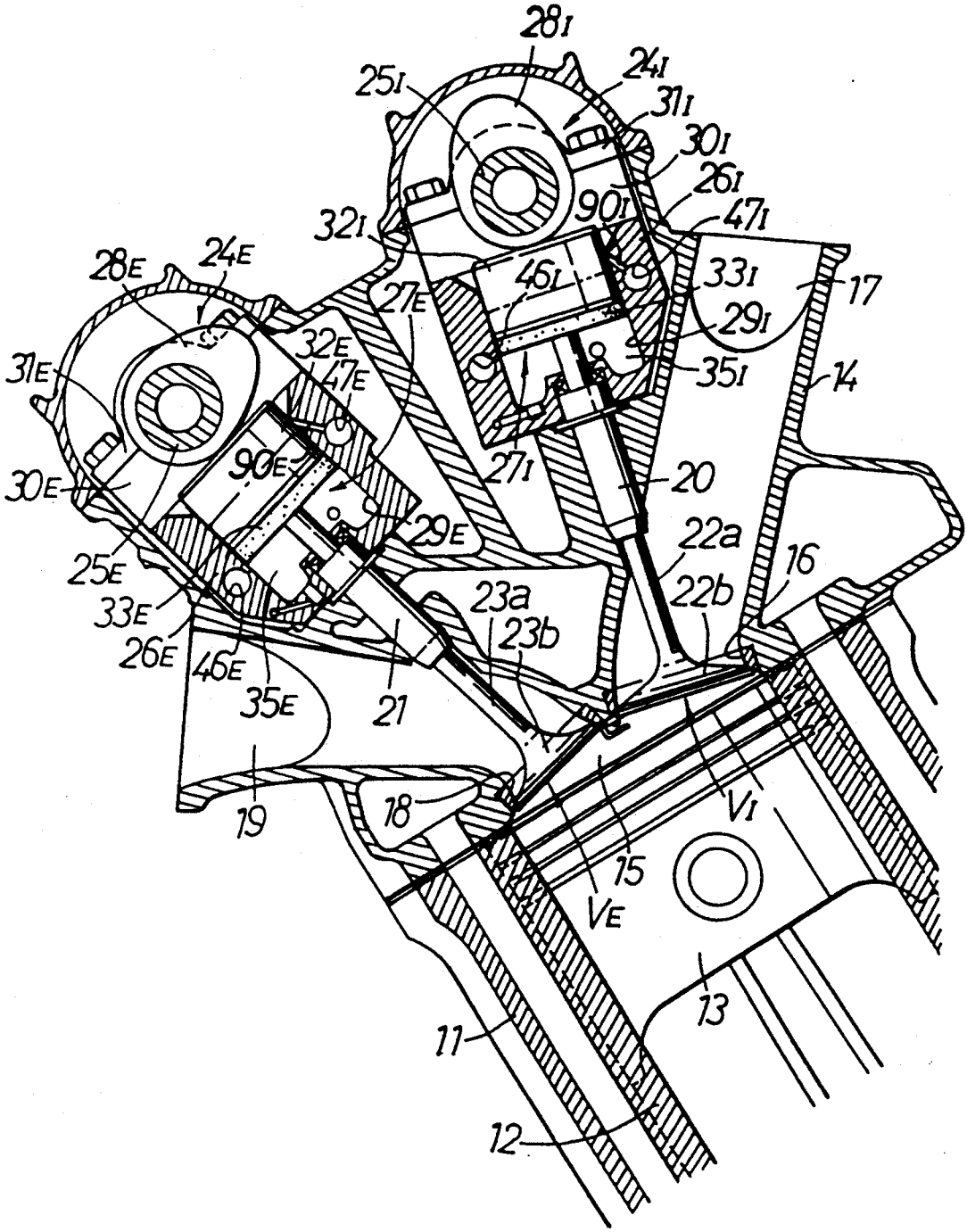
FIG. 16 is similar to FIG. 2 but illustrates a longitudinal sectional view of a valve operating system according to a seventh embodiment of this invention.

FIG. 16 shows a seventh embodiment of the present invention. According to this embodiment, when the air including oil which is released from the air pressure chambers $35_I$ and $35_E$ is circulated to the supply side as in the fifth and sixth embodiments, it is possible to utilize the oil included in such circulated air for preventing seizure which may be generated on the sliding surfaces between the lifters $32_I$, $32_E$ and cams $28_I$, $28_E$ by an increase in the temperature of the air pressure chambers $35_I$ and $35_E$.

In FIG. 16, the slide holes $29_I$ and $29_E$ are provided with ejecting holes $90_I$ and $90_E$, respectively, which are communicated at one end thereof to the intake-side and exhaust-side common supply passages $47_I$ and $47_E$. The other ends of the ejecting hole $90_I$, $90_E$ are opened into upper portions of the slide holes $29_I$ and $29_E$, respectively, such that the ejecting holes $90_I$, $90_E$ are opened when the lifters $32_I$, $32_E$ which are pushed by the cams $28_I$, $28_E$ are lowered to their lowermost positions as shown by dotted lines in FIG. 16.

By this seventh embodiment, when each of the intake and exhaust valves $V_I$, $V_E$ is opened, oil including air therein is ejected from the ejecting hole $90_I$, $90_E$ toward the sliding surfaces between the lifters $32_I$, $32_E$ and the cams $28_I$, $28_E$ respectively, and thus, it is possible to prevent seizure from being generated on the sliding surfaces while avoiding a pressure drop in the intake-side and exhaust-side common supply passages $47_I$, $47_E$ to the minimum degree.

Figure 17:
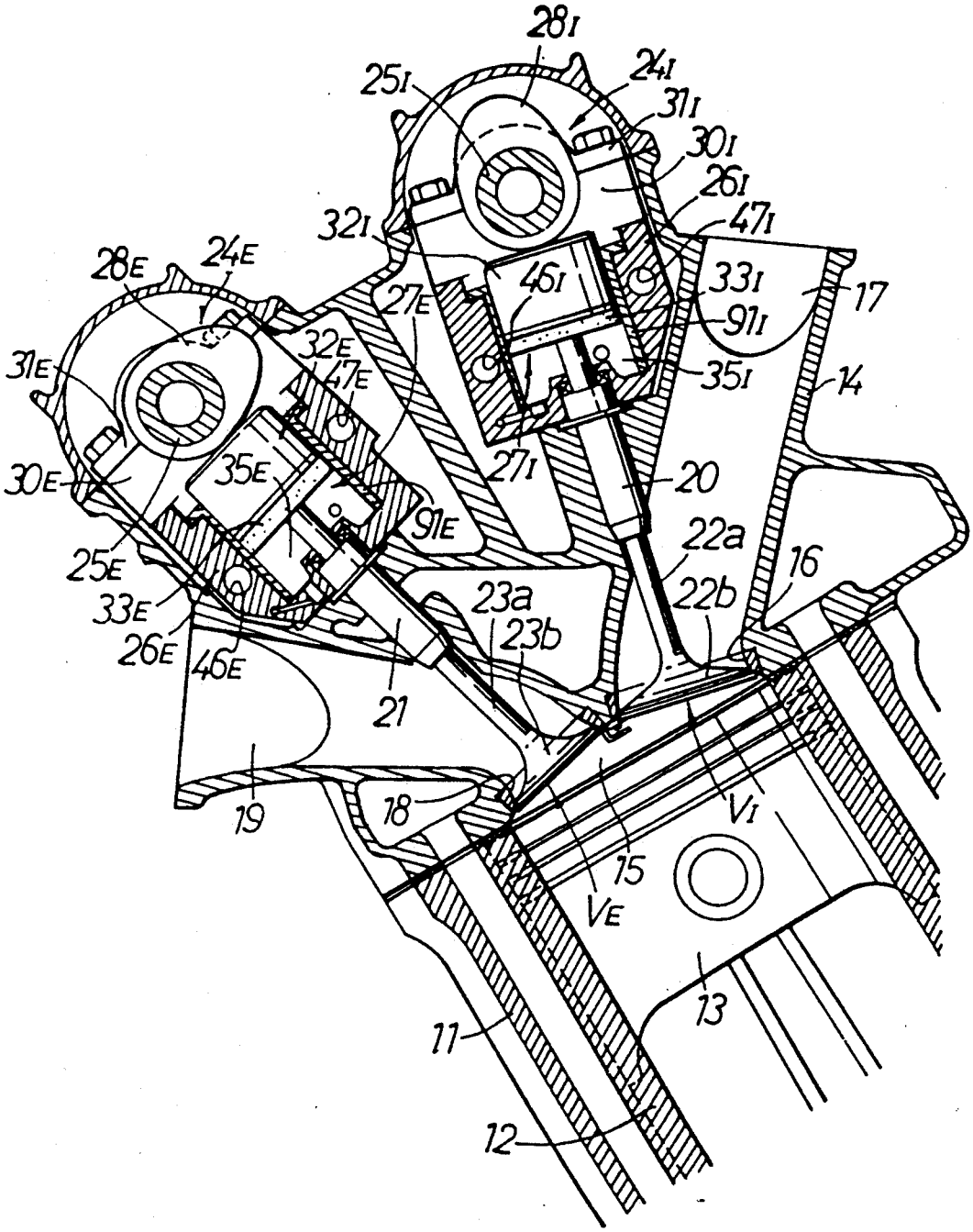
FIG. 17 is similar to FIG. 2 but illustrates a longitudinal sectional view of a valve operating system according to an eighth embodiment of this invention.

FIG. 17 shows an eighth embodiment of the invention, in which cylindrical sleeves $91_I$, $91_E$ in which the pistons $27_I$ and $27_E$ and the lifter $32_I$ and $32_E$ are slidably fitted, are detachably fitted and secured in the pressure component members $26_I$ and $26_E$ respectively, by light-pressfitting, fitting, for example.

By this eighth embodiment, if the sleeves $91_I$, $91_E$ become worn by friction with the pistons $27_I$ and $27_E$ and the lifters $32_I$, $32_E$, the sleeves $91_I$, $91_E$ can be replaced.

Figure 18:
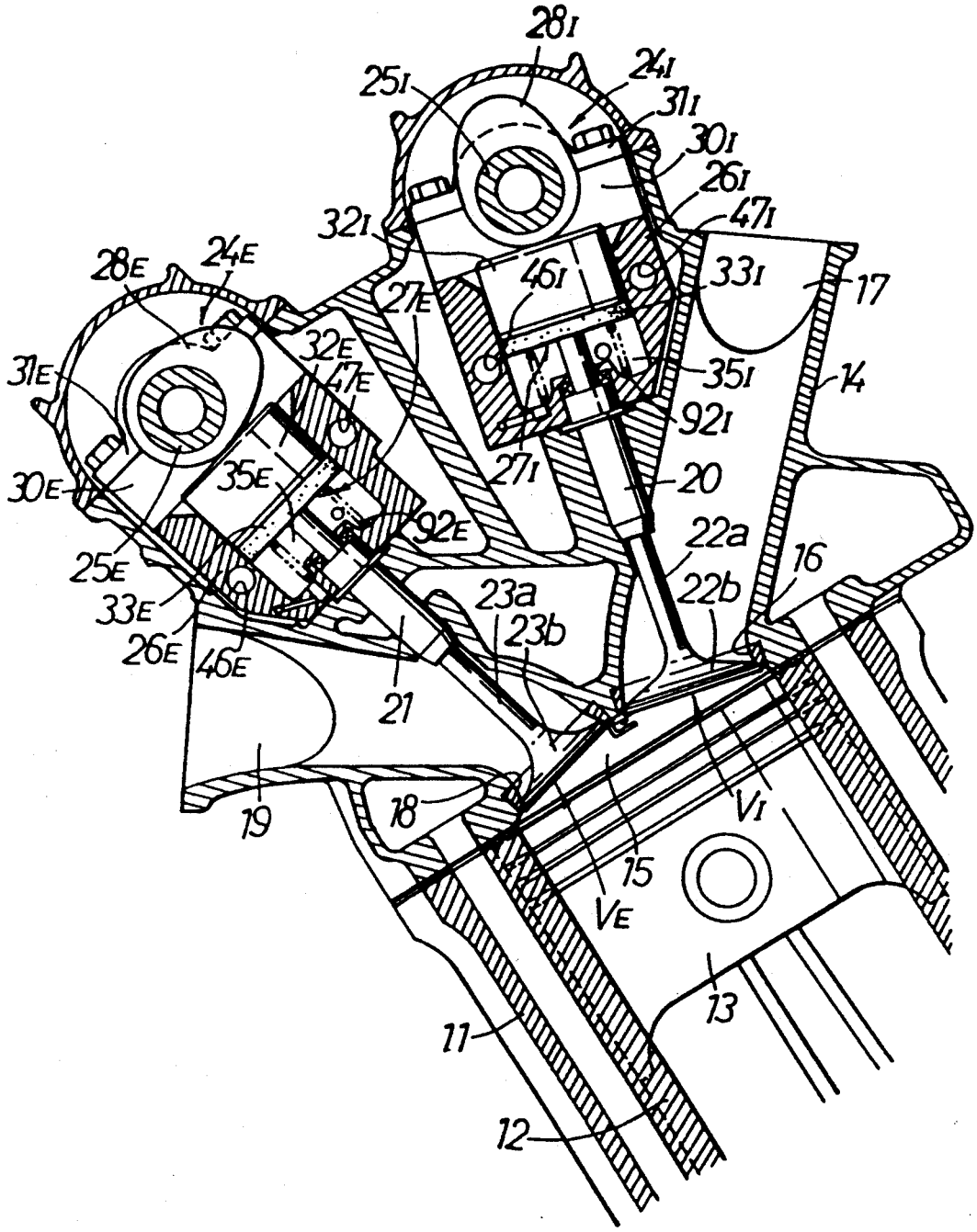
FIG. 18 is similar to FIG. 2 but illustrates a longitudinal sectional view of a valve operating system according to a ninth embodiment of this invention.

FIG. 18 shows a ninth embodiment of the invention. In this embodiment, springs $92_I$, $92_E$ are compressed between the pressure chamber defining members $26_I$ and $26_E$ and the pistons $27_I$ and $27_E$ in the air pressure chambers $35_I$, and $35_E$, respectively. The spring load of each of the springs $92_I$, $92_E$ is set to be extremely small value which is sufficient for preventing lowering movements of the pistons $27_I$ and $27_E$ by pressure drop in the air pressure chambers $35_I$, and $35_E$, respectively.

By this ninth embodiment, even if the internal pressures of the air pressure chambers $35_I$, and $35_E$ are reduced such as when the engine has been left for a long time, it is possible to prevent the lowering movements of the pistons $27_I$ and $27_E$, thereby to prevent the cotter $38_I$ from slipping off and to avoid dropping off of the intake and exhaust valves $V_I$ and $V_E$. Further, at a time of low rotation of the engine such as when starting of the engine, a high air pressure is unnecessary, and the engine can be operated with a reduced friction loss by utilizing the spring forces of the springs $92_I$, $92_E$.

Figure 19:
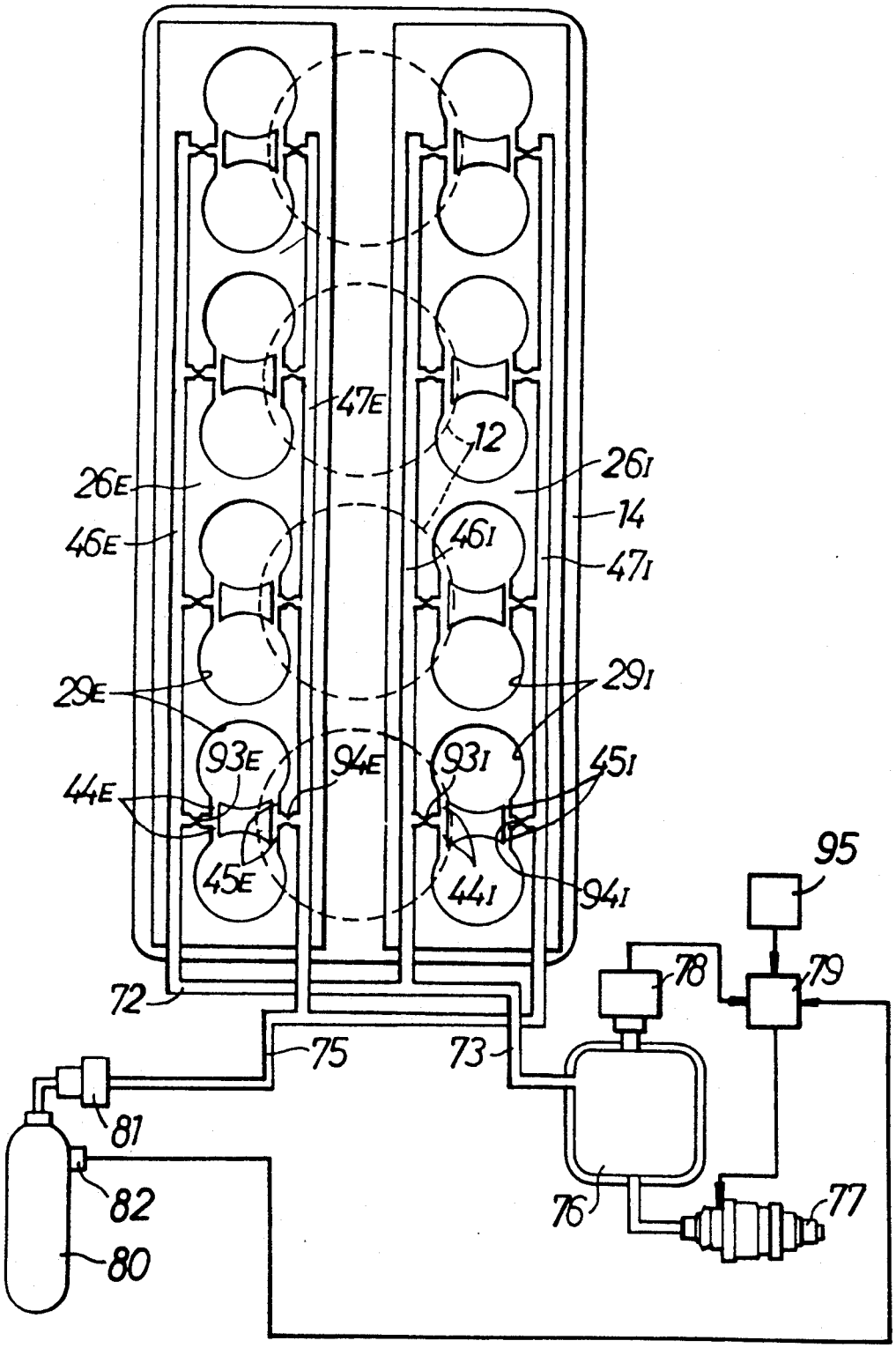
FIG. 19 is similar to FIG. 1 but illustrates a schematic plan view of a valve operating system according to a tenth embodiment of this invention.

FIG. 19 shows the tenth embodiment of the invention. In this embodiment, the intake-side and exhaust-side common relief passages $46_I$ and $46_E$ are connected to the individual relief passages $44_I$, $44_E$ through orifices $93_I$, $93_E$, respectively. And the intake-side and exhaust-side common supply passages $47_1$, $47_E$ are connected to the individual supply passages $45_I$, $45_E$ through orifices $94_I$, $94_E$, respectively.

By this tenth embodiment, the air pressure in each of the air pressure chambers $35_I$ and $35_E$ can be accurately controlled with a good followability with respect to the engine revolution number.

In the above described embodiments, although each of the pressure chamber defining members $26_I$ and $26_E$ is integrally formed with all the cylinders, the pressure chamber defining members can be integrally formed with only some of the cylinders among the multi-cylinders.

Although the embodiments of the present invention have been described above, it will be understood that the present invention is not limited to these embodiments, and various minor modifications in design may be made without departing from the scope of the invention defined in claims.

What is claimed is:

1. A valve operating system in an internal combustion engine, comprising an air pressure chamber biasing an engine valve in a closed direction thereof; an air supply passage connected to said air pressure chamber for supplying air to the air pressure chamber; and a relief passage connected to said air pressure chamber for releasing air from the air pressure chamber; wherein said engine has a plurality of cylinders and said relief passage comprises individual relief passages individually connected to a said air pressure chamber for each of said plurality of cylinders, a single common relief passage commonly connected to said individual relief passages, and a pressure control valve is connected to said common relief passage for controlling the pressure in said air pressure chambers.

2. A valve operating system for an internal combustion engine according to claim 1, wherein said common relief passage is provided at an intermediate portion thereof with a volume chamber, said pressure control valve being connected to said common relief passage at a position downstream of said volume chamber.

3. A valve operating system for an internal combustion engine according to claim 2, wherein said volume chamber is provided therein with separating means for separating oil from air.

4. A valve operating system for an internal combustion engine according to claim 1, wherein a relief valve is provided in each said individual relief passage upstream of said pressure control valve.

5. A valve operating system for an internal combustion engine according to claim 4, wherein an individual relief passage connects each of two adjacent air pressure chambers to said relief valve.

6. A valve operating system for an internal combustion engine according to claim 5, wherein said two adjacent air pressure chambers are for two either intake or exhaust valves for a cylinder of the internal combustion engine.

7. A valve operating system for an internal combustion engine according to claim 1, wherein a supply check valve means is provided between each air pressure chamber and said air supply passage.

8. A valve operating system in an internal combustion engine comprising an air pressure chamber biasing an engine valve in a closed direction thereof; an air supply passage connected to said air pressure chamber for supplying air to the air pressure chamber; a relief passage connected to said air pressure chamber for releasing air from the air pressure chamber; a pressure control valve connected to said relief passage for controlling the pressure in said air pressure chamber; relief pressure detecting means for detecting a pressure in said relief passage, and a control unit which controls an opening and closing operation of said pressure control valve so as to maintain air pressure in said air pressure chamber at a target value on the basis of a value detected by said relief pressure detecting means, which said control unit stops the opening operation of said pressure control valve when said target value is changed to a larger value.

9. A valve operating system for an internal combustion engine according to claim 8, wherein an accumulator including accumulator internal pressure detecting means is connected to said air supply passage, and wherein said control unit is arranged, when a value detected by said accumulator internal detecting means is smaller than a predetermined value, to change said target value to a larger value than that when the value detected by said accumulator internal detecting means was equal to or larger than said predetermined value.

10. A valve operating system in an internal combustion engine comprising an air pressure chamber biasing an engine valve in a closed direction thereof; an air supply passage connected to said air pressure chamber for supplying air to the air pressure chamber; a relief passage connected to said air pressure chamber for releasing air from the air pressure chamber; and a pressure control valve connected to said relief passage and at an exit side of said pressure control valve to said air supply passage through a return passage for controlling the pressure in said air pressure chamber, said return passage being provided at an intermediate portion thereof with a check valve.

11. A valve operating system for an internal combustion engine, comprising an air pressure chamber biasing an engine valve in a closed direction thereof; an air supply passage connected to said air pressure chamber for supplying air to the air pressure chamber; a relief passage connected to said air pressure chamber for releasing air from the air pressure chamber; a pressure control valve connected to said relief passage for controlling the pressure in said air pressure chamber; said engine having a plurality of cylinders and a pressure chamber defining member secured to a cylinder head of the engine so as to correspond to at least some of said plurality of cylinders; a cam shaft common to said at least some of the cylinders operatively connected with pistons, each of which is secured to an engine valve, for each of said at least some of the cylinders; said pistons being each slidably received in said pressure chamber defining member to define said air pressure chamber between said piston and said pressure chamber defining member, and said pressure chamber defining member being provided, commonly for all of said air pressure chambers, with passage means which form portions of said relief passage and said air supply passage, respectively.

12. A valve operating system for an internal combustion engine according to claim 11, wherein a plurality of sleeves in which said respective pistons are slidably fitted are detachably fitted and secured to said pressure chamber defining member.

13. A valve operating system for an internal combustion engine according to claim 11, wherein bearing means are formed in said pressure chamber defining member for rotatably supporting said cam shaft.

14. A valve operating system in an internal combustion engine, comprising an air pressure chamber biasing an engine valve in a closed direction thereof; an air supply passage connected to said air pressure chamber for supplying air to said air pressure chamber; and a relief passage connected to said air pressure chamber for releasing air from the air pressure chamber; wherein said engine has a plurality of cylinders and a pressure chamber defining member is secured to a cylinder head of said engine so as to correspond to at least some of the plurality of cylinders; a cam shaft common to said at least some of the cylinders is operatively connected with pistons, each of which is secured to an engine valve, for each of said at least some of the cylinders; said pistons are each slidably received in the pressure chamber defining member, and said pressure chamber defining member being provided, commonly for all of the air pressure chambers, with passage means which form portions of the relief passage and the air supply passage, respectively.

15. A valve operating system for an internal combustion engine according to claim 14, wherein a plurality of sleeves in which s id respective pistons are slidably fitted are detachably fitted and secured to said pressure chamber defining member.

16. A valve operating system according to claim 14, wherein bearing means are formed in said pressure chamber defining member for rotatably supporting said cam shaft.

17. A valve operating system according to claim 14, wherein relief valve means are mounted in said pressure chamber defining member for individually controlling said releasing air from each said air pressure chamber to said relief passage.

18. A valve operating system according to claim 14, wherein check valve means are mounted in said pressure chamber defining member for individually controlling said supplying air to each said air pressure chamber from said air supply passage.

* * * * *